US007574870B2

(12) United States Patent
Filippone

(10) Patent No.: US 7,574,870 B2
(45) Date of Patent: Aug. 18, 2009

(54) AIR-CONDITIONING SYSTEMS AND RELATED METHODS

(75) Inventor: Claudio Filippone, 8708 48th Pl., College Park, MD (US) 20740

(73) Assignee: Claudio Filippone, College Park, MD (US)

( * ) Notice: Subject to any disclaimer, the term of this patent is extended or adjusted under 35 U.S.C. 154(b) by 480 days.

(21) Appl. No.: 11/489,493

(22) Filed: Jul. 20, 2006

(65) Prior Publication Data

US 2008/0035312 A1 Feb. 14, 2008

(51) Int. Cl.
*F25B 27/00* (2006.01)

(52) U.S. Cl. ..... 62/119; 62/235.1; 62/238.1; 60/641.8

(58) Field of Classification Search ..... 62/235.1, 62/238.1, 467, 119; 60/641.8, 670
See application file for complete search history.

(56) References Cited

U.S. PATENT DOCUMENTS 2,002,457 A 5/1935 Barber
2,002,497 A 5/1935 Barber
2,109,237 A 2/1938 Lustig
2,360,969 A 10/1944 Newcombe
2,446,059 A 7/1948 Peterson et al.
2,636,345 A 4/1953 Zoller
2,769,302 A 11/1956 Purdie et al.
2,895,297 A 7/1959 Gardiner
2,903,862 A * 9/1959 Bouchard ..... 62/231
3,128,605 A 4/1964 Malaker et al.
3,360,929 A 1/1968 Drewry
3,705,492 A 12/1972 Vickers
3,747,336 A 7/1973 Dibelius et al.
3,766,891 A 10/1973 Csathy et al.
3,777,484 A 12/1973 Dibelius et al.
3,823,573 A * 7/1974 Cassady ..... 62/238.4
3,908,936 A * 9/1975 Durran ..... 244/117 A (Continued)

FOREIGN PATENT DOCUMENTS

DE 657608 3/1938

(Continued)

OTHER PUBLICATIONS

U.S. Appl. No. 11/487,501 and US Patent Application Publication US 2008/0041362A1, Electrical Generator Systems and Related Methods, Jul. 17, 2006.

(Continued)

*Primary Examiner*—William E Tapolcai

(57) ABSTRACT

Various embodiments of air conditioning systems are disclosed. The systems may include an air conditioner whose energy source is provided by heating of a first fluid. The first fluid may be in a liquid state contained in a reservoir hydraulically connected to a first chamber. The first chamber may be configured to receive thermal energy utilized to convert the first fluid into a vapor. The system may also include a second chamber hydraulically connected to the first chamber to receive the vaporized fluid from the first chamber. The second chamber may be configured to condense the vaporized first fluid, causing depressurization in the second chamber. The system may be configured such that the depressurization of the second chamber may drive an external fluid through an expanding valve in addition to an energy converter (e.g. Turbine Generator) overall able to convert the first fluid condensing energy into cooling and mechanical or electrical energy.

41 Claims, 4 Drawing Sheets

U.S. PATENT DOCUMENTS 3,979,913 A 9/1976 Yates
3,988,646 A 10/1976 Atkins et al.
4,177,651 A * 12/1979 McFarland ..... 62/238.1
4,211,073 A 7/1980 Guillot
4,213,299 A 7/1980 Sharar
4,259,841 A 4/1981 Thomas
4,264,844 A 4/1981 Axe et al.
4,297,842 A 11/1981 Gerhold et al.
4,339,925 A 7/1982 Eggmann et al.
4,366,674 A 1/1983 Eakman
4,420,945 A * 12/1983 Dibrell ..... 62/86
4,429,538 A 2/1984 Sato et al.
4,446,692 A 5/1984 Adkins
4,474,014 A 10/1984 Markowski
4,571,935 A 2/1986 Rice
4,628,687 A 12/1986 Strom
4,687,946 A 8/1987 Jones
4,747,271 A * 5/1988 Fischer ..... 60/670
4,840,537 A 6/1989 Silvestri, Jr.
4,866,941 A 9/1989 Stock
4,899,538 A 2/1990 Shekleton
4,912,931 A 4/1990 Joshi et al.
4,928,481 A 5/1990 Joshi et al.
4,996,845 A 3/1991 Kim
5,013,236 A 5/1991 Khinkis
5,199,255 A 4/1993 Sun et al.
5,291,735 A * 3/1994 Kesten ..... 62/4
5,333,458 A 8/1994 Loving
5,351,487 A 10/1994 Abdelmalek
5,367,871 A 11/1994 Venkataramani et al.
5,434,454 A 7/1995 Farkas
5,515,681 A 5/1996 DeFreitas
5,528,904 A 6/1996 Jones et al.
5,679,931 A 10/1997 Furse et al.
5,735,126 A 4/1998 Schulte-Werning
5,758,501 A 6/1998 Jirnov et al.
5,778,657 A 7/1998 Ohtomo et al.
5,802,841 A 9/1998 Maeda
5,839,270 A 11/1998 Jirnov et al.
5,855,112 A 1/1999 Bannai et al.
5,896,740 A 4/1999 Shouman
5,906,095 A 5/1999 Frutschi et al.
6,018,941 A 2/2000 Massey
6,098,398 A 8/2000 Uematsu et al.
6,105,362 A 8/2000 Ohtomo et al.
6,109,019 A 8/2000 Sugishita
6,220,013 B1 4/2001 Smith
6,263,661 B1 7/2001 van der Burgt et al.
6,370,862 B1 4/2002 Cheng
6,374,613 B1 4/2002 Filippone
6,438,962 B1 8/2002 Blain et al.
6,474,069 B1 11/2002 Smith
6,477,842 B1 11/2002 Nagata et al.
6,529,849 B2 3/2003 Umezawa et al.
6,543,214 B2 4/2003 Sasaki et al.
6,672,070 B2 1/2004 Bland et al.
6,711,889 B2 3/2004 Kuo et al.
6,729,137 B2 5/2004 Filippone
6,804,962 B1 * 10/2004 Prueitt ..... 60/641.8
7,047,722 B2 5/2006 Filippone
7,299,616 B2 11/2007 Filippone
7,340,918 B1 * 3/2008 Leban et al. ..... 62/467
7,430,865 B2 10/2008 Filippone

FOREIGN PATENT DOCUMENTS

GB 283042 1/1928
GB 751192 6/1956

OTHER PUBLICATIONS

U.S. Appl. No. 11/184,835, Solar Pump Systems and Related Methods, Jul. 20, 2005.

* cited by examiner

AIR-CONDITIONING SYSTEMS AND RELATED METHODS

DESCRIPTION OF THE INVENTION

1. Field of the Invention

The present invention relates to a gas cooling-system (e.g. air-conditioning) driven by heat energy. In particular, the present invention relates to a gas expansion chamber configured to operate below atmospheric pressures. Heat energy, for example Solar Energy, heats up a suitable fluid inside an expansion chamber within which, by means of a particular thermodynamic cycle, it is made to condense. Once the fluid is condensed inside the chamber under a particular configuration it can cause a substantial pressure drop. At this point a second fluid (e.g. a gas) may flow inside the chamber as a result of the pressure drop. Expansion of the second fluid inside the chamber provokes its temperature to drop. A heat exchanger in thermal contact with the second fluid may extract the cooling effects of the second fluid by transferring heat to, for example, another fluid (e.g. Air or a liquid), say a third fluid which can then be utilized to cool down a controlled environment. A particular configuration of a system within which the cooled third fluid circulates can be utilized in place of an air-conditioning unit with the net benefit that the energy source is heat, for example from solar energy, instead of electricity.

2. Description of Related Art

Various heat driven cooling devices have been widely used in the past. In 1821, J. T. Seebeck discovered that dissimilar metals, connected at two different locations (junctions), develop a micro-voltage, granted the two junctions are held at different temperatures, this is called the Seebeck effect. In 1834, another scientist Peltier discovered a principle that is the inverse of the Seebeck effect: The "Peltier effect." Peltier found that by coupling junctions of dissimilar metals (thermocouples) and applying a voltage across such junctions causes a temperature difference between the junctions. This results in a Thermo-Electric Cooler (TEC). TECs, are generally bulky and use several thermocouples in series designed to allow significant heat transfer from and to the Peltier element. An improved version of the TECs uses heavily doped semiconductor. Despite highly sophisticated semiconductor technologies and improved heat transfer techniques Peltier elements are still very inefficient and very expensive. These systems consume more power than they actually transport. Peltier elements may consume twice-as-much energy in the form of electricity as they transform such energy in another form: heating and cooling. In other words, electricity goes into the Peltier device and only a fraction is converted into cooling. The great majority of the electricity is actually converted into heat as the heat sink for heat dissipation out of the device is much larger than the heat sink through which the device transfers its cooling effects. Most importantly, although its functioning depends on temperature differences Peltier elements still need electricity.

It is accordingly a primary object of the proposed invention to provide a system able to cool any suitable fluid, by using heat (e.g. solar energy) to drive a thermodynamic engine whose principle may be based on the expansion of a suitable fluid inside a depressurized chamber.

SUMMARY OF THE INVENTION

It is accordingly an object of the present invention to provide an inexpensive cooling system by converting thermal energy, solar energy or heat energy from any source, to heat-up and condense a fluid inside a chamber. The chamber may be hydraulically connected to various components of the system in a way that the thermodynamic processes occurring to a selected working fluid flowing inside the chamber are substantially based on induced pressure variations inside the chamber. These pressure variations are then utilized to expand another fluid, or the same fluid as the selected working fluid, thereby lower its temperature. Finally the temperature drop is utilized to cool down air or any suitable fluid to transport the cooling effects to desired locations (i.e. air-conditioning duct system of a household).

Cooling of a fluid may be achieved by utilizing one or more sources of heat (e.g. solar, waste heat from industrial processes). This thermal energy may be utilized to first convert for example water, or any other suitable fluid, into vapor. Subsequently, the so generated vapor may be condensed in a controlled manner so as to cause a controlled pressure-drop inside a properly designed tank. The system is arranged in such a way that the pressure-drop may cause displacement or expansion of a desired amount of a fluid. While the fluid is expanded its temperature drop may be utilized for various application including for example air-conditioning.

To attain the advantages and in accordance with the purpose of the invention, as embodied and broadly described herein, one aspect of the invention provides means to utilize pressure differences to expand a fluid, for example, to cool down a closed environment.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

DESCRIPTION OF THE EXEMPLARY EMBODIMENTS

Reference will now be made in detail to the exemplary embodiments of the invention, examples of which are illustrated in the accompanying drawings. Wherever possible, the same reference numbers or letters will be used throughout the drawings to refer to the same or like parts.

The air-conditioning systems, according to an exemplary embodiment of the invention, utilize heat energy to displace a controlled volume of fluid (e.g., liquid), between different locations to fill up a tank with superheated vapors. The system converts generally heat energy, for example solar energy, to vaporize (e.g., to a super-heated thermodynamic state) a working fluid inside one or more heat absorbing heat exchangers (i.e., referred hereinafter as Vapor-Heat Exchanger, "V-HEX" in the various Figures). The system then condenses the vapor, by inducing sudden cooling inside a Super Tank (S-Tank) designed to sustain a vacuum as well as pressures above atmospheric pressure.

Induced condensation of the vapor may be achieved by injecting vapor cooling liquids (e.g., in the form of spray, jets) into the vapor-filled S-Tank, or by exposing the vapor filled inner portions of S-Tank to controlled cooling means exchanging heat with the walls of S-Tank. The timing, and degree, of the condensation processes may be controlled by adjusting, for example, the fluid injection timing, flow rate, and temperature of the cooling liquid. As heat and mass transfer occurs between the cooling liquid and the vapor, the vapor inside the S-Tank may be rapidly condensed, resulting in a S-Tank pressure drop close to a vacuum. The S-Tank may be designed to withstand such a pressure drop as well as pressures above atmospheric pressures, for example if the vapor accumulated becomes super-heated and pressurized, thereby leading to higher pressures. The pressure drop subsequent to condensation may be used in a variety of applications, including, for example, cooling of a fluid and generating electricity.

As is apparent, the air-conditioning systems of the present invention may utilize an unusual thermodynamic cycle. For example, while most thermodynamic cycles operate on the principle of fluid expansion to drive turbines or expanders, thereby converting the expansion energy of the fluid into mechanical energy, the air-conditioning system of the present invention may operate based on fluid "contraction." Although a fluid contraction cycle may be generally less efficient than the classical expansion cycles, systems as the ones proposed in this invention may be simpler to manufacture (i.e., thereby less expensive), may not quickly deteriorate with the passing of time, and may not require forced fluid circulation for its operation as the depressurization energy can be utilized to provide energy to the various actuators described in the discussions that follows.

Figure 1:
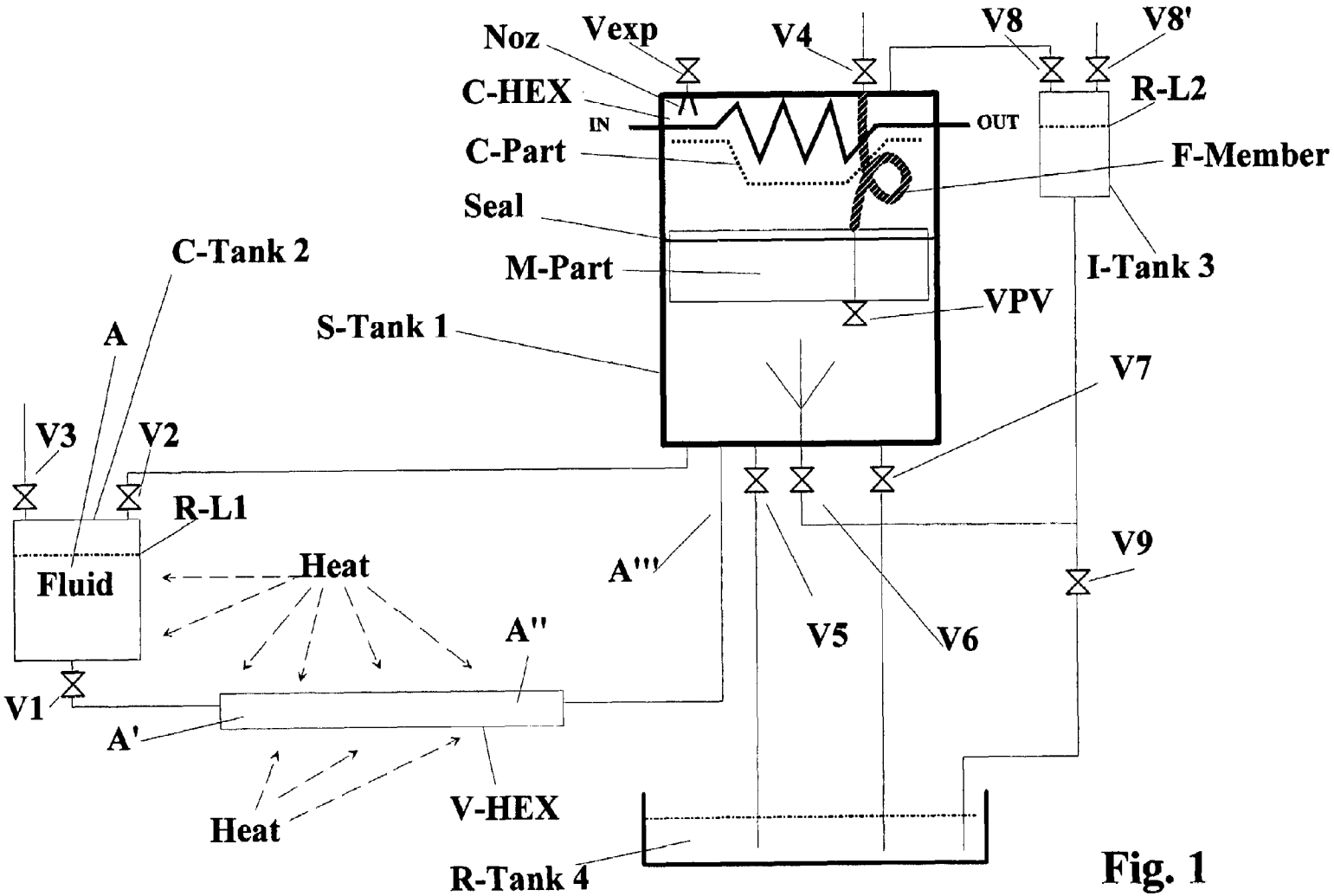
FIG. 1 is a schematic illustration of an air-conditioning system, according to an exemplary embodiment of the invention, illustrating an exemplary application of generating a cooling gas by expanding it inside a chamber.

According to an exemplary embodiment of the invention, FIG. 1 schematically illustrates an air-conditioning system configured to displace a volume of liquid from different locations so as to create the preconditions for a forced fluid condensation and subsequent pressure decrease inside S-Tank. While the invention will be described in connection with a particular air-conditioning arrangement (i.e., utilizing the cooling effects of an expanding fluid from an high pressure to a low pressure), the invention may be applied to, or used in connection with, any other types of fluid displacement applications, such as, for example, transporting fluid from one place to another, cooling an displace any suitable fluid. Naturally, it should be understood that the invention may be used in various applications other than air-conditioning.

As shown in FIG. 1, the air-conditioning system may comprise a Reservoir Tank (R-Tank 4) containing the working fluid (e.g., water), one or more heat absorbing and vapor generating V-HEX for evaporating the working fluid, the super tank, S-Tank 1 for rapidly condensing the vaporized fluid, and the injector water tank (I-Tank 3) containing fluid in a liquid state and used for cooling the vaporized fluid inside S-Tank 1. Water will be used to describe the exemplary embodiments of the invention, particularly for the application illustrated with reference to FIG. 1. It should be understood, however, that any other fluid having suitable thermodynamic properties may be used alternatively or additionally. Fluids represented in FIGS. 1, 2 and 4 and contained within C-Tank 2, R-Tank 4, and I-Tank 3 may have the same thermal physical characteristics as well as different thermal-physical characteristics as long as they are compatible with the thermodynamic cycle indicated in FIG. 3. The elevation difference between the various tanks (e.g. C-Tank 2, R-Tank 4, etc.) of this invention may be arbitrary as R-Tank 4 may be positioned above C-Tank 2. I-Tank 3 may be at a higher elevation with respect to S-Tank 1 if the driving pressure for the water injection is gravity. Alternatively, the water r injection can occur in several additional ways, for example by pressurized water.

With reference to FIG. 1, the Collector Tank C-Tank 2 may use gravity to inject a certain amount of water inside the V-HEX where heating of the water takes place via heat energy absorption, (e.g. solar, waste heat absorption, or more generally "Heat" as indicated by the generalized notation in FIG. 1). The water in the V-HEX may then be transformed into vapors (e.g., super-heated steam), and the vapors may flow (e.g., via natural circulation and pressure) to the S-Tank 1, where the vapors may be accumulated. The S-Tank 1 may be designed to sustain a substantial amount of negative pressure, and may be equipped with one or more valves (shown in, for example, FIGS. 1, 2, and 4) to purge substantially all non-condensable gases (e.g. Air) present in the S-Tank 1. A mobile partition M-Part may separate the relatively high temperature accumulating vapors from another internal region of S-Tank 1. One or more vapor purging valves VPV hydraulically connected, for example, through a flexible member may allow expulsion of non-condensable gases (e.g. via V4) while the mobile partition M-Part is moving. A pressurization of the lower portion of S-Tank 1 may be necessary to provide the necessary force to move M-Part. M-Part can also be gravity or spring assisted. Once a predetermined amount of vapors are accumulated in the S-Tank 1, the I-Tank 3 injects sub-cooled water jet (e.g., via gravity) inside the S-Tank I by controlled actuation of Valve V6, causing an instant cooling and pressure drop inside the S-Tank 1. At this time, the system may reset the water levels "Reference Level 2" (R-L2) inside the I-Tank 3, by means of properly timing valves V8 and V9 (described with reference to FIGS. 1, 2, and 4). V8 may be actuated to allow suction of water from R-Tank 4 through valve V9 while S-Tank 1 pressure is close to a vacuum as a result of vapor condensation. In addition R-L2 is reset I-Tank 3 is also reset for the next cycle. Alternatively, and to expedite the condensation process without utilizing large amount of water from I-Tank 3, once the condensation process has been initiated V5 may be actuated so as to allow suction of water from R-Tank 4 to S-Tank 1. In this case, while fluid is flowing from R-Tank 4 to S-Tank one or more turbine system coupled to an electric generator may be utilized to generate electricity, for example to run the various system's actuators, computer controllers, or the fans or pumps to transfer the resulting cooled fluid to different locations. At equilibrium a certain amount of water may be transferred from R-Tank 4 to S-Tank 1 while S-Tank is now at a very low pressure, or substantially a vacuum. To reset Reference Level 1 (R-L1) in C-Tank 2, valves V3, V2, and V4 may be actuated so as to allow water from S-Tank 1 to flow into C-Tank 2, if at a lower elevation with respect to S-Tank 1. Also if excess water needs to be returned to R-Tank 4, the system may be configured in such a way that while water returns to R-Tank 4 it also generates electricity through a turbine/generator system. The near vacuum pressure conditions inside S-Tank 1 may be utilized to expand another fluid (e.g. Air), or generally a "second fluid" (where the second fluid may have the same-as well as different thermal physical characteristics as the first fluid) via actuation of expansion valve Vexp. The second fluid expands through a throttling thermodynamic process or (in addition or independently of the throttling device) via nozzle Noz (FIG. 1). While the second fluid expands the temperature of the region of S-Tank 1 exposed to the expansion drops. A cooling insulating partition C-Part may be positioned inside S-Tank 1 so as to minimize heat transfer between the expanding fluid and the system working fluid (e.g. the accumulated vapor/condensate). A cooling heat exchanger C-HEX positioned near the expanding second fluid nozzle may be utilized to extract the cooling effects of the expanding second fluid, for example via circulation of a third fluid through the C-HEX inlet and outlet (e.g. IN, OUT FIG. 1). While the second fluid expands M-Part returns to its original position while the pressure inside S-Tank 1 approaches atmospheric pressures. At this time the system is re-set to its initial conditions wherein V1 may be actuated again and vapor is newly formed inside V-HEX, thereby accumulating inside S-Tank 1, and restarting the thermodynamic cycle. As M-Part moves as a result of pressurization and depressurization on the non-vapor side of S-Tank 1 (top side in the representation in FIG. 1) it purges all air, or second fluid accumulated in the previous cycle possibly without compressing it (e.g. via opening of Vexp as a mechanism to vent to atmospheric pressure).

Figure 2:
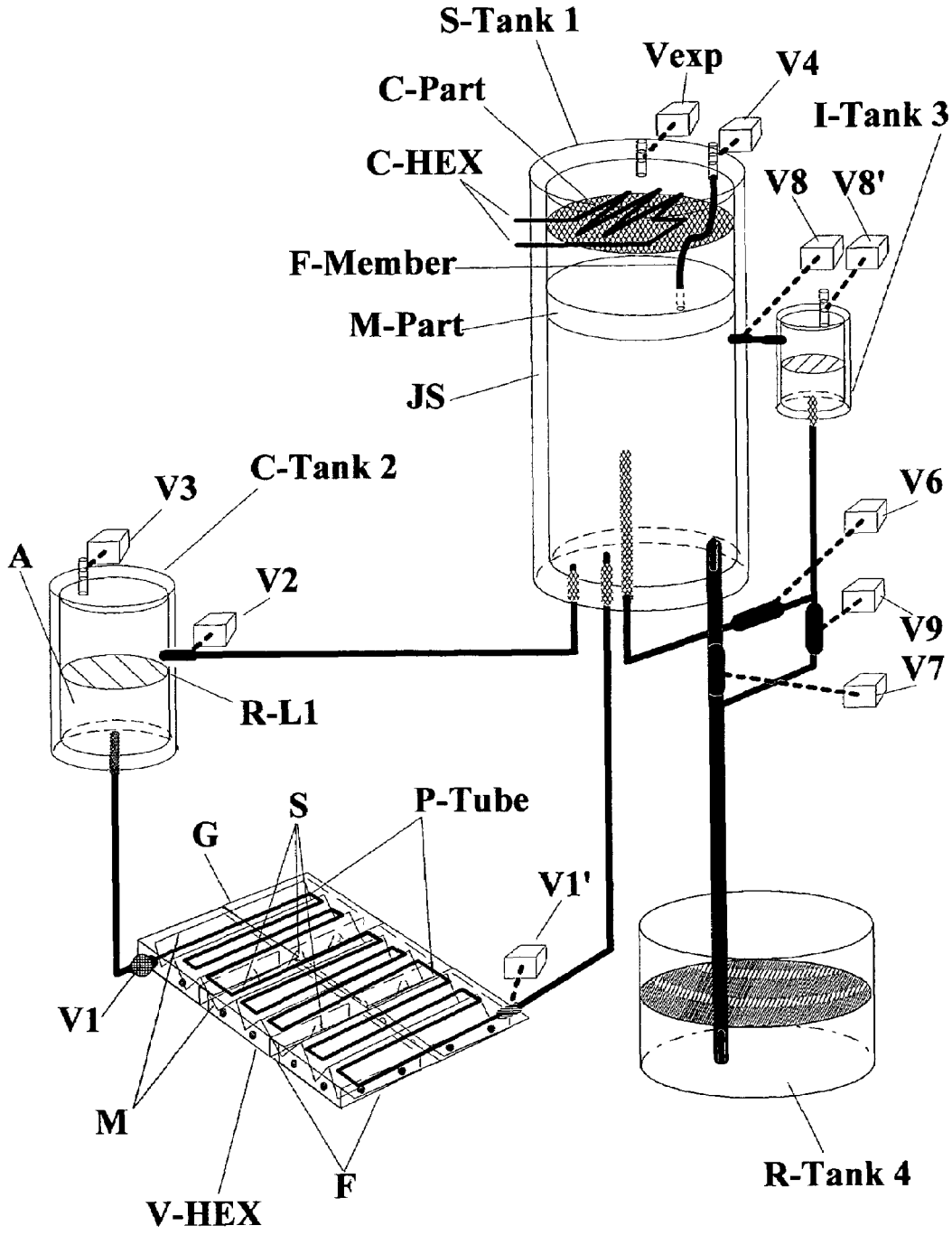
FIG. 2 is a schematic of an electric generator system, shown in FIG. 1, illustrating various components thereof and utilizing a heat exchanger and a mobile partition with and separate fluid heat exchanger.

With reference to FIG. 2, various operational processes are described in detail. In this figure, the V-HEX here represented as an example may be configured to absorb heat energy from solar radiation. In this case the V-HEX can be constructed in a way that solar energy may be transferred to the heat exchanger while minimizing convective heat transfer effects with the surrounding environment. When the heat source is mainly radiative (e.g. solar radiation), the V-HEX may be formed by a frame F (FIG. 2) within which a coil of a pressure tube "P-Tube" (for example coated with solar radiation absorbing materials) may be mechanically suspended in a vacuum. At least one side of frame F allows sun radiation absorption into the P-Tube for example by means of a glass cover G with high transmissivity and low reflectivity. Inside the evacuated frame F and acting as support mechanisms for the glass surface G, and to withstand the glass G buckling generated by the vacuum, a series of spacers or mechanical supporters S of suitable geometry may be used. To optimize solar radiation absorption into the P-Tube, and placed on the side opposite to the glass G at the bottom side of frame F, a series of mirrors M may be placed inside the frame F so as to re-direct sun radiation not directly absorbed by the P-Tube. Depending on the geometry adopted for the coil formed by the P-Tube the mirrors M may be of different geometry (e.g. corrugated, conical, cylindrical etc.) The V-HEX is not limited to a particular dimensional and/or geometric configuration, and multiple V-HEX may be installed side-by-side, for example, on a surface exposed to the sun, or, also as another example, as part of a heat exchanger within which waste heat fluids flow without mixing with the working fluid (in this case the working fluid is inside the pressure tube P-Tube). Multiple V-HEX may be hydraulically connected by means of suitable hydraulic fittings. To summarize on the V-HEX, each of the V-HEX may include at least one inlet and at least one outlet for hydraulic connections and to allow fluid flow between the various components of the air conditioning system.

Once vapor is formed inside V-HEX it may flow into S-Tank 1. S-Tank 1 may be thermally separated from the environment by a jacket structure (JS). JS may be actuated so as to have a vacuum or free convection by operating a suitable set of valves, or through a combination of mechanical means. Overall, when inside JS there is a vacuum or it is thermally insulated the S-Tank 1 can more efficiently fill-up with vapors as the rate of natural condensation on the S-Tank 1 inner surfaces is decreased. When inside JS environmental air or cooling fluids are allowed to flow the rate of condensation is increased, thereby optimizing the depressurization process inside S-Tank 1. Therefore, JS may be a jacket with which heat transfer and heat insulating mechanisms are actuated according to the thermodynamic cycle shown in FIG. 3A and FIG. 3B (expansion and cooling of a gas). To summarize, JS is set to form a high insulation, for example via a vacuum or insulating materials or fluids, JS favors the vapor process accumulation process inside S-Tank 1. However, when free convection or actuation of cooling systems induce increased heat transfer through JS (from the surfaces of S-Tank 1 to a cooler environment), then JS favors condensation inducing the vapor inside S-Tank 1 to condense at a higher rate.

In FIG. 2, V1 represents a check valve, while V1' may be actuated to increase the super-heating pressure of the vapor prior its inlet into S-Tank 1. Valves V8', V3 and V4 may allow venting to atmospheric pressures and may be actuated according to a sequence as indicated by the thermodynamic cycle represented in FIG. 3A. The water in the C-Tank 2 may be at the atmospheric pressure and temperature. Alternatively, the water may be heated and/or pressurized. In some exemplary embodiments, the water may be pre-heated. Pre-heating may occur by solar heat or any other source of heat, and may speed-up the vaporization process inside the V-HEX. For this purpose C-Tank 2 itself may be configured to receive solar or thermal energy (e.g. waste heat). For example, at least a portion of C-Tank 2 may be made of a material that is transparent to solar irradiation, such that the solar rays may heat-up the inner portions of the tank and heat up fluid A (FIGS. 1, 2, and 4). In an exemplary embodiment, the inner portions of C-Tank 2 may be coated with a material having a relatively high absorptivity and low reflectivity. Alternatively, if the heat source is heat in the form of a fluid carrying the heat (e.g. waste heat) C-Tank 2, as for V-HEX, may be embedded with the heat source and exposed to the heat stream (e.g. hot gases, or generally hot fluids as shown in the V-HEX of FIG. 4), or directly in contact with the waste heat source wherein the heat transfer mechanism may be conduction for example through the waste heat generating equipment of some industrial processes. As for FIG. 1 the mobile partition M-Part thermally separates the vapor accumulating process (e.g. lower regions of S-Tank 1) from the fluid expansion process occurring through expansion valve Vexp or through nozzle Noz (e.g. top portions of S-Tank 1 as represented in this exemplary embodiment—different geometries and positioning of M-Part are also possible). Vapor purging valve(s) VPV in FIG. 1 and FIG. 4, V4 in FIG. 2 may be utilized to purge the non-condensable gases prior to the controlled condensation and subsequent depressurization of S-Tank 1. The flexible member F-Member may be a flexible hydraulic connection thermally insulated and configured in a way that allows M-Part motion without impediments.

According to another exemplary embodiment of the invention shown in FIG. 4, the air conditioning system may include a turbine and electric generator T1, E-Gen1 system operated by the expansion of an external fluid EXT. F. The EXT. F may be in a gaseous (e.g. Air), or liquid form (e.g. a refrigerant). In this configuration nozzle valves VN may be actuated when S-Tank 1 pressure is close to a vacuum as a result of the thermodynamic cycle described earlier and represented in FIG. 3A and FIG. 3B. EXT. F may flow or expand through TI as a result of the pressure difference between the environment outside S-Tank 1 and the inner S-Tank 1 volume. To further minimize heating of the EXT.F in FIG. 4 a flexible body or flexible membrane F-MEM may separate the vapor and vapor-condensing areas of S-Tank 1. In the system configuration shown in FIG. 4, a portion (e.g. top side of S-Tank 1) of the inner walls of S-Tank 1 may be formed by insulating materials so as to minimize heating of the external fluid EXT.F while expanding. Alternatively JS can be actively an insulation or a heat transfer system as previously described. VPV represents vapor-purging valves hydraulically connected to the F-MEM which may be actuated during the S-Tank 1 vapor accumulation processes.

Figure 3A:
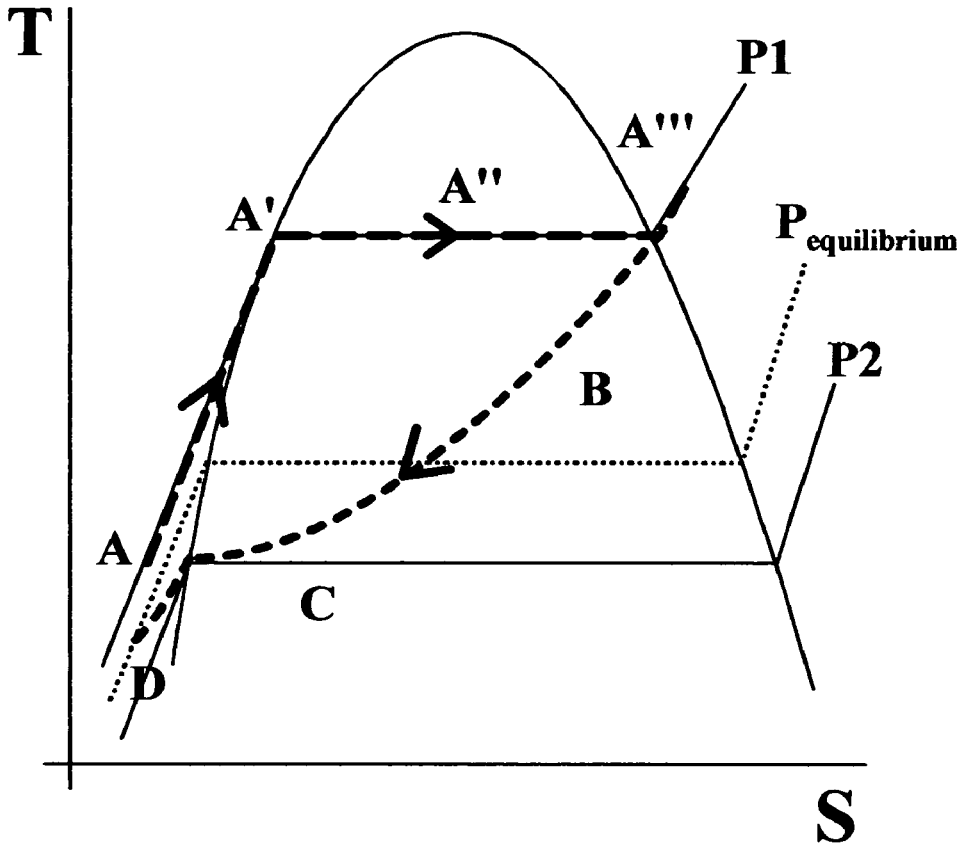
FIGS. 3A and 3B represent a Temperature-Entropy (T-S), and a Pressure Volume diagrams illustrating various exemplary thermodynamic processes of the heat addition and condensation, as well as a fluid expansion and decreased temperature.
Figure 3B:
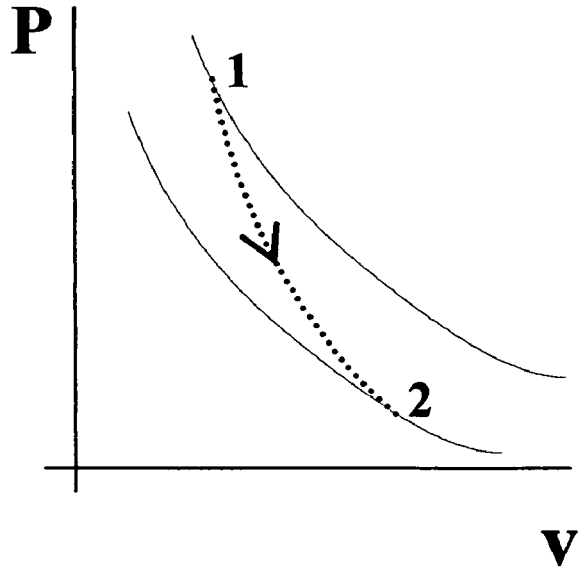
Figure 4:
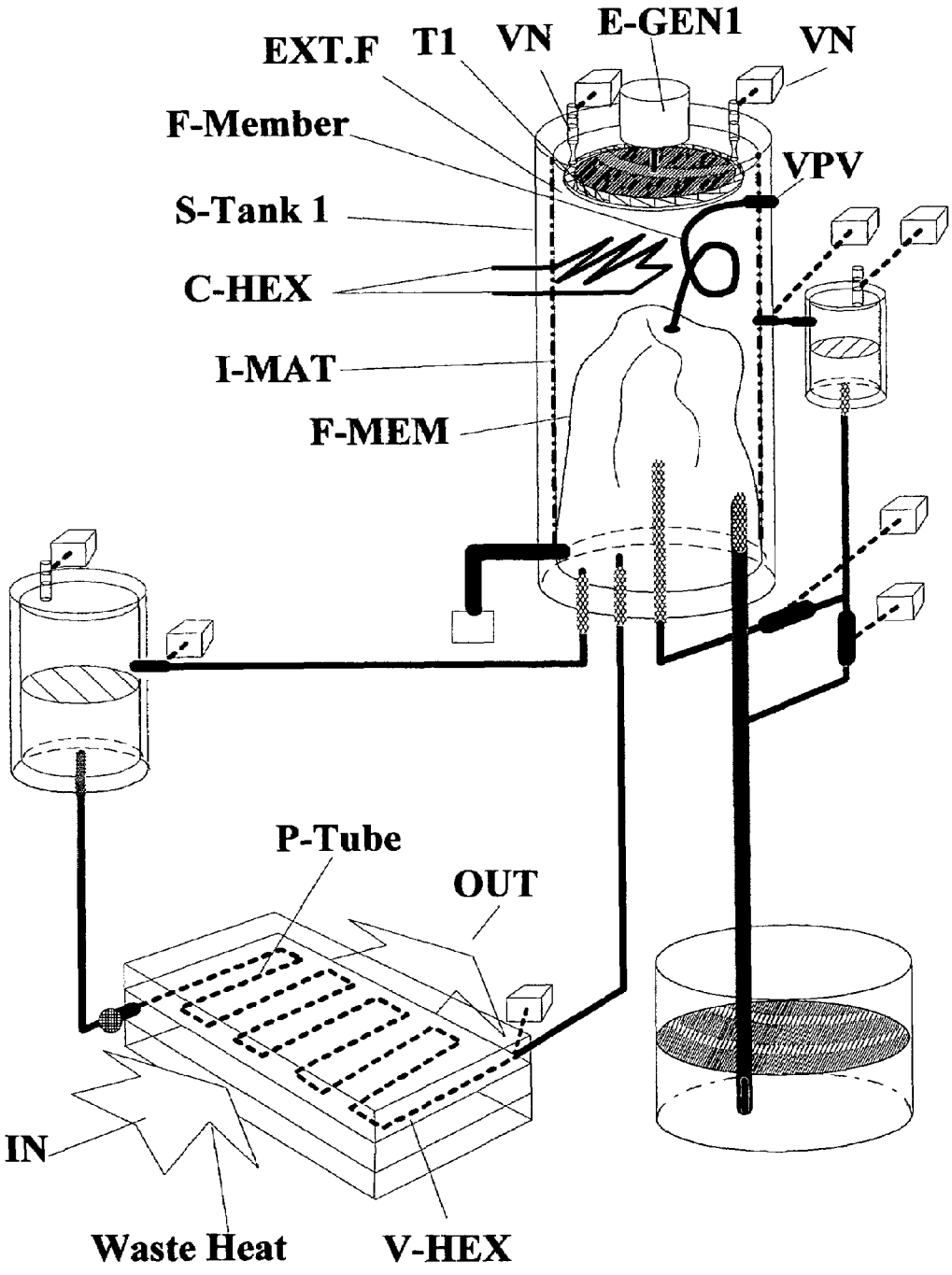
FIG. 4 is a schematic of an air-conditioning system utilizing an electric generator operating while a gas expands and cools down inside a specially designed tank.

With reference to FIG. 3A and FIG. 3B a more detailed illustration of the principles and thermodynamic processes occurring inside the various components of the invention is now provided. Once a predetermined amount of water (e.g. A in FIG. 1), is introduced into the V-HEX, the heat addition received therein may be transferred to the water. This is process A, A', A", and A'" as indicated in the T-S diagram of FIG. 3A. Process A-A'" represent a heat addition process moving along the isobaric line P1 in which water transforms from sub-cooled liquid into superheated steam. At this point the fluid may be at a superheated thermodynamic state A"-A'" on an indicative isobaric line P1. P1 may be atmospheric pressure.

Therefore, water starts at thermodynamic state A, absorbs heat inside V-HEX and exits V-HEX as superheated steam through valve V1' (FIG. 2). Valve V1' may be automatically operated and may be configured to control the vapor condition (e.g., degree of super-heating of the vapor). This may be necessary for example to assure deployment of F-MEM (FIG. 4), or M-Part in FIG. 1. Alternatively, or in addition, a check valve can automatically control the venting of vapors from V-HEX into S-Tank 1. The inner walls of S-Tank 1 may be built to withstand vacuum or negative pressures with materials and/or coatings to minimize cooling during the vapor filling process while maximizing cooling during vapor condensation, or by actively actuate JS.

Overall, in a certain amount of time, for example depending on V-HEX dimensions and heat transfer from the heat source to V-HEX, super-heated vapors occupy all of the S-Tank 1 volume by purging non-condensable gases (e.g. air) through open valve V4 (FIGS. 1, and 2), or, in the case of F-MEM utilization, through vapor purging valve VPV (FIG. 4). This may be point A'" in the T-S diagram in FIG. 3A. By opening valve V8' connected to I-Tank 3 the pressure inside I-Tank 3 can be equalized at a pressure near or at atmospheric pressure, and the cooler fluid it contains can flow into S-Tank 1 via brief actuation of valve V6. This alone or in addition to the heat transfer effects of the JS can induce cooling inside S-Tank 1, thereby causing the pressure to drop to a substantial vacuum indicated by the representative isobaric line P2 also in the T-S diagram in FIG. 3A. This process is a non-equilibrium-process, therefore the dashed line indicated by B is only representative of a condensation process occurring while the system pressure (S-Tank 1 pressure) decreases. At this time the super heated vapor initially at thermodynamic state A'" is all condensed through processes B, C and D in the T-S diagram (FIG. 3A). When valve V5 in FIGS. 1, and 2, or one or more nozzle valves VN in FIG. 4 are actuated in an open state the pressure inside S-Tank 1 increases from a vacuum. When the system is configured according to FIGS. 1 and 2 and a substantial amount of water is displaced from R-Tank 4 to S-Tank 1 the final equilibrium pressure will be below P1 (FIG. 3A). When the system is configured to expand or allow flow of an external fluid EXT. F as shown in FIGS. 1, 2 and 4 the final S-Tank 1 pressure may approach P1. If a minimum amount of water is displaced from R-Tank 4 (or no water is displaced at all) the near vacuum condition inside S-Tank 1 may be utilized to cool a gas trough its expansion from a higher to a lower pressure. This is the process shown in FIG. 3B. As it is well known compressing a gas implies heating of the gas, and expanding a gas implies cooling of the gas. This simple gas-cooling phenomenon can now be used to cool down another fluid or media. This can be attained through a cooling heat exchanger C-HEX within which a circulating fluid can be cooled. Depending on the final application, the C-HEX can be also formed by a cooling media for example via conduction between thermally conductive materials.

To further thermally separate the mobile partition M-Part from the expanding gas an additional cooling partition C-Part can be utilized in a way that allows pressure gradients while minimizing heat transfer effects with the surfaces of M-Part. To allow return of the condensed and displaced water inside S-Tank 1 back to R-tank 4, the pressure inside S-Tank 1 is equalized with atmospheric pressure through Vexp and, or in addition to, via actuation of valve V4 in FIG. 1 and FIG. 2. A similar result may be achieved by actuating nozzle valve(s) VN in FIG. 4.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A cooling system comprising:

a reservoir containing first fluid in a liquid state;

a first chamber hydraulically connected to the reservoir to receive the first fluid from the reservoir, the first chamber being configured to receive heat energy and configured to convert the received heat energy to vaporize the first fluid;

a second chamber having a partition member for dividing the second chamber into a first subchamber and a second subchamber, the first subchamber being hydraulically connected to the first chamber to receive the vaporized fluid from the first chamber; and a heat exchanger configured to thermally communicate with the second subchamber, wherein the first subchamber is configured to condense the vaporized first fluid, causing depressurization within the first subchamber.

2. The system of claim 1, wherein the second subchamber of the second chamber comprises an opening in fluid communication with a second fluid.

3. The system of claim 2, wherein the opening includes a valve.

4. The system of claim 2, wherein the second fluid comprises air from atmosphere.

5. The system of claim 1, wherein the partition member is movable within the second chamber.

6. The system of claim 5, wherein the partition member is substantially rigid and is slidable along a longitudinal axis of the second chamber.

7. The system of claim 5, wherein the depressurization within the first subchamber causes the partition member to move so as to decrease the volume of the first subchamber and increase the volume of the second subchamber, causing a decrease in temperature inside the second subchamber.

8. The system of claim 1, wherein at least one of the first and second fluids is water.

9. The system of claim 1, further comprising an injector configured to inject condensing liquid into the first subchamber to condense the vaporized first fluid.

10. The system of claim 9, further comprising an injector tank for supplying the condensing liquid to the injector.

11. The system of claim 9, wherein the injector is configured to spray the condensing liquid into the second chamber.

12. The system of claim 1, wherein the first fluid in the reservoir flows to the first chamber via gravity.

13. The system of claim 1, wherein the hydraulic connection between the reservoir and the first chamber comprises a valve configured to be actuated automatically based on a parameter inside at least one of the reservoir, the first chamber, and the second chamber.

14. The system of claim 13, wherein the valve comprises a flow control valve configured to control an amount of water being introduced into the first chamber.

15. The system of claim 1, wherein the first chamber is configured to receive solar energy and configured to convert the solar energy to vaporize the first fluid.

16. The system of claim 15, wherein the first chamber comprises a heat absorbing material.

17. The system of claim 1, wherein the first chamber is in the form of a tile.

18. The system of claim 1, wherein the first chamber comprises an insulator surrounding at least a portion of the first chamber.

19. The system of claim 18, wherein the insulator comprises a vacuum jacket.

20. The system of claim 1, wherein the first chamber comprises a plurality of first chambers.

21. The system of claim 20, wherein the plurality of first chambers are hydraulically connected in series between the reservoir and the second chamber.

22. The system of claim 20, wherein the plurality of first chambers are hydraulically interconnected to each other.

23. The system of claim 20, wherein the plurality of first chambers are placed adjacent to one another.

24. The system of claim 1, wherein the hydraulic connection between the first chamber and the second chamber comprises a valve configured to control the condition of the vaporized first fluid flowing from the first chamber into the first subchamber of the second chamber.

25. The system of claim 24, wherein the valve is configured to be automatically actuated when pressure and/or temperature inside the first chamber exceeds a threshold value.

26. The system of claim 1, wherein the second chamber comprises a relief valve located in an upper portion of the second chamber and configured to release non-condensable fluid.

27. The system of claim 1, wherein the first subchamber of the second chamber is hydraulically connected to the reservoir to allow the condensed first fluid to the reservoir.

28. The system of claim 1, further comprising an electric generator coupled to the second chamber to generate electricity.

29. The system of claim 1, wherein the first fluid and the second fluid do not mix one another.

30. A method of cooling, comprising:

providing a chamber having a movable partition member for separating the chamber into a first subchamber and a second subchamber;

vaporizing a first fluid and allowing the vaporized first fluid to flow into the first subchamber;

condensing the vaporized first fluid in the first subchamber, causing depressurization of the first subchamber and increase in the volume of the second subchamber, wherein the volume increase of the second subchamber causes the temperature inside the second subchamber to decrease; and placing a portion of a heat exchanger in contact with the second subchamber so as to allow heat exchange between the interior of the second subchamber and a fluid passing through the heat exchanger.

31. The method of claim 30, wherein heating the first fluid comprises heating the first fluid with solar energy.

32. The method of claim 30, further comprising storing the first fluid in a reservoir.

33. The method of claim 30, wherein the first fluid is water.

34. The method of claim 30, wherein the second subchamber comprises an opening in fluid communication with a second fluid.

35. The method of claim 34, wherein the opening includes a valve.

36. The method of claim 34, wherein the second fluid comprises air from atmosphere.

37. The method of claim 30, wherein the partition member is substantially rigid and is slidable along a longitudinal axis of the chamber.

38. The method of claim 30, wherein condensing the vaporized first fluid comprises injecting condensing liquid into the first subchamber.

39. The method of claim 30, further comprising controlling a vapor condition of the vaporized first fluid flowing into the first subchamber.

40. The method of claim 39, wherein controlling the vapor condition comprises controlling the vapor condition of the vaporized first fluid via a valve.

41. The method of claim 40, wherein the valve is configured to be automatically actuated when at least one of the pressure and temperature inside the first chamber exceeds a threshold value.

* * * * *